US007216717B2

(12) United States Patent
Severin et al.

(10) Patent No.: US 7,216,717 B2
(45) Date of Patent: May 15, 2007

(54) DUAL ELEVATOR SYSTEM AND METHOD

(75) Inventors: Iwo Severin, Luebeck (DE); Jens Lutzhoeft, Hamburg (DE); Jörn Grotherr, Halstenbek (DE)

(73) Assignee: Blohm + Voss Repair GmbH (DE)

( * ) Notice: Subject to any disclaimer, the term of this patent is extended or adjusted under 35 U.S.C. 154(b) by 287 days.

(21) Appl. No.: 11/066,741

(22) Filed: Feb. 25, 2005

(65) Prior Publication Data

US 2006/0191689 A1 Aug. 31, 2006

(51) Int. Cl.
*E21B 19/06* (2006.01)
*E21B 19/14* (2006.01)

(52) U.S. Cl. ..... 166/379; 166/380; 166/85.1; 166/77.52; 294/102.2

(58) Field of Classification Search ..... 166/77.1, 166/77.52, 77.53, 85.1, 380; 294/102.1, 294/102.2, 86.29; 188/67
See application file for complete search history.

(56) References Cited

U.S. PATENT DOCUMENTS

| | | | | |
|---|---|---|---|---|
| 3,063,509 | A | 11/1962 | Guier | |
| 3,099,323 | A * | 7/1963 | Kelley | 175/85 |
| 3,308,970 | A * | 3/1967 | Wilson et al. | 414/22.51 |
| 4,389,760 | A | 6/1983 | Krasnov | |
| 4,421,447 | A | 12/1983 | Gudgel et al. | |
| 4,492,134 | A | 1/1985 | Reinholdt et al. | |
| 4,625,796 | A | 12/1986 | Boyadjieff | |
| 4,709,766 | A | 12/1987 | Boyadjieff | |
| 4,765,401 | A | 8/1988 | Boyadjieff | |
| 4,793,422 | A | 12/1988 | Krasnov | |
| 4,800,968 | A | 1/1989 | Shaw et al. | |
| 5,340,182 | A | 8/1994 | Busink et al. | |
| 5,909,768 | A | 6/1999 | Castille et al. | |
| 6,237,684 | B1 | 5/2001 | Bouligny, Jr. et al. | |
| 6,309,002 | B1 | 10/2001 | Bouligny | |
| 6,386,283 | B1 | 5/2002 | Mosing et al. | |
| 6,443,241 | B1 | 9/2002 | Juhasz et al. | |
| 6,520,709 | B1 | 2/2003 | Mosing et al. | |
| 6,557,641 | B2 | 5/2003 | Sipos et al. | |
| 6,568,479 | B2 | 5/2003 | Mosing et al. | |
| 6,637,526 | B2 | 10/2003 | Juhasz et al. | |
| 2006/0027375 | A1 * | 2/2006 | Thomas et al. | 166/380 |
| 2006/0191690 | A1 * | 8/2006 | Severin et al. | 166/379 |

* cited by examiner

*Primary Examiner*—David Bagnell
*Assistant Examiner*—Robert E Fuller
(74) *Attorney, Agent, or Firm*—Gary L. Bush; Andrews Kurth LLP

(57) ABSTRACT

A dual elevator system and method which, in one embodiment, includes two elevators and a table for supporting one or both of the elevators thereon, for shuttling an elevator between well center and offset standby positions, and for hands-free coupling and uncoupling power and control to an elevator on the table by remote actuation. Each elevator has a rear power and control connector and hitch which connect to complementary connectors and hitch located on a table shuttle mechanism by remote actuation. The table shuttle mechanism is driven by an actuator coupled between the shuttle mechanism and table frame which moves an elevator hitched to said shuttle mechanism between well center and standby positions.

15 Claims, 10 Drawing Sheets

DUAL ELEVATOR SYSTEM AND METHOD

BACKGROUND OF THE INVENTION

1. Field of the Invention

This invention relates generally to drilling equipment used particularly in the hydrocarbon production industry and specifically to an elevator system and method for running or raising tubulars in a well.

2. Description of the Prior Art

In the hydrocarbon production industry, tubular goods, including drill strings, casings and tubing and often referred to simply as tubulars, must at varying stages be run, i.e. lowered, into or raised from a well. Elevators are devices which support the tubular for the purpose of raising or lowering it. An elevator may clamp along the side of a tubular using slips and dies to exert a radial clamping force on the tubular wall, or an elevator may use a bushing to support the tubular at the lower lip of a box connector. The latter method is preferable for deep water production or when running heavy casings or landing strings, because a slip can exert damaging crushing forces on the tubular under high hook loads.

FIGS. 1 and 2 show one typical elevator setup of prior art where an elevator (10) is suspended from a top drive mechanism (9) by a pair of bails, or links (14), which have eyes (16, 18) at both ends. The top drive mechanism (9) is in turn suspended by a traveling block (12) and wire rope (19) rigged from a crown block (not shown) located in the top of the drilling rig. The upper eyes (16) of the pair of bails (14) are hooked to the link supports (20) of the top drive (9), and the lower eyes (18) of the pair of bails (14) are hooked to the ears (22) protruding from the elevator (10). The bails (14) are secured to the elevator ears (22) by locking mechanisms (25) to prevent the bails (14) from inadvertently becoming uncoupled from the elevator (10). The elevator (10) and the supported tubular (24) are thus raised and lowered by the traveling block (12)/top drive (9) and bails (14). All the components in this series are designed to carry the expected loads.

The top drive (9) is used in place of a conventional rotary table and Kelly bushing to rotate the tubular during rotary drilling. Using hydraulic or electric motors (11) and a gear train (13) suspended above the drill string (24) enables the drill string to be rotated continuously while being lowered into or raised from a well. The top drive mechanism slides up and down along frame members (15) to check rotation of the top drive in reaction to the spinning of the tubular (24) while allowing free vertical movement of the device.

A spider, much like an elevator, is a device which supports a tubular to prevent it from descending into a well when it is not held by an elevator. Unlike an elevator, however, the spider is designed to remain on the drilling deck and is not moved vertically. When the elevator, suspended by the traveling block, nears its high limit of travel (when raising a tubular) or its low limit or travel (when running a tubular), or when a stand is required to be added or removed, the elevator must be repositioned in order to continue the operation. The spider supports the tubular prior to the elevator releasing the tubular. Thus, the tubular is held in place while the elevator is repositioned. Once the elevator carries the tubular at a new location, the spider is disengaged allowing the tubular to freely pass through the spider or for the spider to be moved completely clear of the tubular.

In some drilling platforms, particularly those used for deep water production, a large number of stands is required to be on hand. In such platforms, the derrick may become cluttered, hindering operations and increasing operation time. To simplify the operation, it has been known to use a first elevator as a temporary substitute for a spider to support a tubular and a second elevator, coupled to the traveling block, to lower the tubular string. Each elevator is preferably equipped with a door for side entry of a tubular. When the second traveling elevator is holding the tubular, the first spider elevator is moved clear of the tubular. The second elevator and tubular are lowered. When the second elevator has been lowered to the rig floor, the bails are removed from the second elevator and attached to the nearby first elevator. The second elevator now acts as the spider, holding the tubular while the first elevator is repositioned towards the top of the string where it supports the tubular or is used to move a new stand to the top of the string which is coupled thereto. The second elevator then releases the tubular and is moved clear of the tubular, and the first elevator lowers the tubular into the well. When the first elevator reaches the rig floor, the elevators are again swapped in a process sometimes referred to as circulating the elevators. The same process is used in a reverse sequence for raising a tubular. Because both elevators change their location continuously during this process, there is no need for elevator/spider differentiation.

A coordinated dual elevator system simplifies the process of circulating the elevators. A dual elevator system may incorporate features such as a shuttle table to receive the traveling elevator on deck for use as a spider, to readily move a spider elevator off of well center to prepare its use as a traveling elevator, and to vacate the landing table for receiving the next traveling elevator. In other words, the shuttle table is used to move the spider elevator into and out of engagement with a tubular at well center.

Many elevators and spiders used today employ power operated internal mechanisms, e.g., power doors and/or power slips. The powered elevators and spiders are commonly hydraulic, but can be pneumatic or electric. When circulating the elevators, power and control lines can interfere with deck operations, becoming entangled or snagging on objects. Additionally, uncoupling and re-coupling supply lines is also a burdensome manual process, particularly for hydraulic systems. Therefore, the process of circulating elevators has traditionally been limited to manually operated elevators. A method and apparatus which simplifies the supply of power to powered elevators when circulating the elevators is desirable.

3. Identification of Features of one or more Embodiments of the Invention

A primary object of the invention is to provide a method and apparatus for increasing the efficiency of drilling operations by automating the process of circulating elevators and by allowing for the use of powered elevators in the process of circulating elevators.

Another object of the invention is to provide a method and apparatus which prevents the need for riggers or other personnel to manually connect or disconnect power and control lines for an elevator or to manually move an elevator from well center to an offset standby position or vice versa.

Another object of the invention is to provide a method and apparatus for providing power and control to an elevator in a manner which does not cause power or control lines to hamper or otherwise interfere with deck operations.

Another object of the invention is to promote operator safety by providing for total hands-free operation of the elevator.

SUMMARY OF THE INVENTION

The objects identified above, as well as other features and advantages of the invention are incorporated in a dual elevator system and method comprising two elevators and a skid assembly or table for supporting one or both of the elevators thereon, for preferably hands-free shuttling an elevator between well center and offset standby positions, and for preferably hands-free coupling or uncoupling power and control to an elevator on the table by remote actuation. In a preferred embodiment, each of the two elevators is adapted for holding a tubular and being suspended by a pair of bails by elevator ears. Each elevator preferably has a rear power and control connector assembly for powering and controlling internal elevator systems. The rear power and control connector assembly is designed and arranged for coupling to a complementary second connector assembly by remote actuation. Each elevator also preferably has a hitch which is designed and arranged to push or pull said elevator along a table surface and for removable attachment to a complementary second hitch by remote actuation. The hitch and rear power and control connector assembly are preferably combined in a single block which is pivotally mounted to the elevator. Each elevator preferably has a door assembly designed and arranged to allow side entry of a tubular.

In a preferred embodiment, a skid assembly or table for supporting one or both of the elevators is characterized by a well center elevator position and a standby elevator position adjacent to said well center elevator position. The skid assembly includes a frame, a first skid surface located at the well center elevator position, and a second skid surface located at the standby elevator position, with the second skid surface positioned relative to said first skid surface to allow smooth sliding or rolling of an elevator between the standby position and the well center position, and vice versa. The skid assembly includes a shuttle mechanism which preferably moves along the skid surfaces and has a hitch and multi-coupling system connector assembly mounted thereto which attaches by remote actuation to elevator hitch and quick connectors at the rear power and control connector assembly. The shuttle mechanism is driven by an actuator, preferably a piston/cylinder arrangement, coupled between said shuttle mechanism and the skid assembly frame. The actuator is sized to move an elevator hitched to the shuttle mechanism between the well center and standby positions.

Preferably, the table may further include wheels coupled to said frame in movable relation characterized by engaged positions and disengaged positions such that when the wheels are in the disengaged positions, the skid assembly frame rests on the drilling deck, and when the wheels are in the engaged positions, the frame is carried by the wheels for free movement about the drilling deck.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 1:
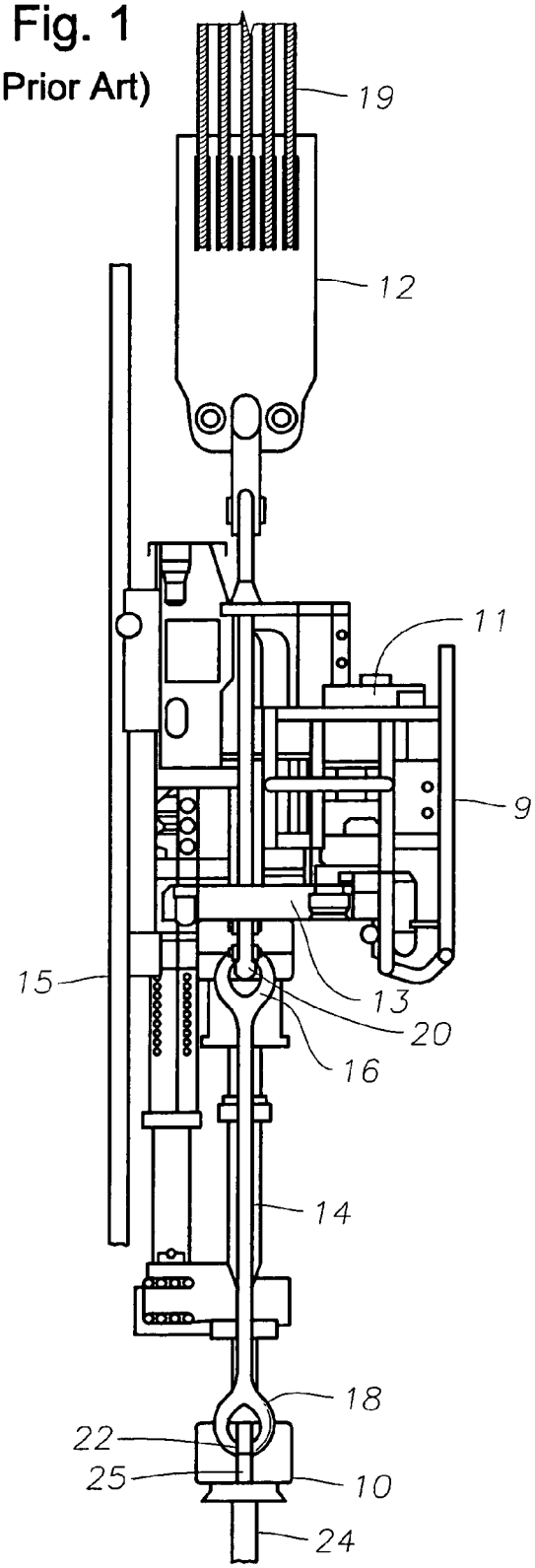
Fig. 1 (Prior Art)
FIG. 1 is a side view of a prior art arrangement for lowering or raising a tubular including an elevator which holds the tubular, bails suspending the elevator by its protruding ears from a top drive mechanism, and a traveling block which carries the entire arrangement.
Figure 2:
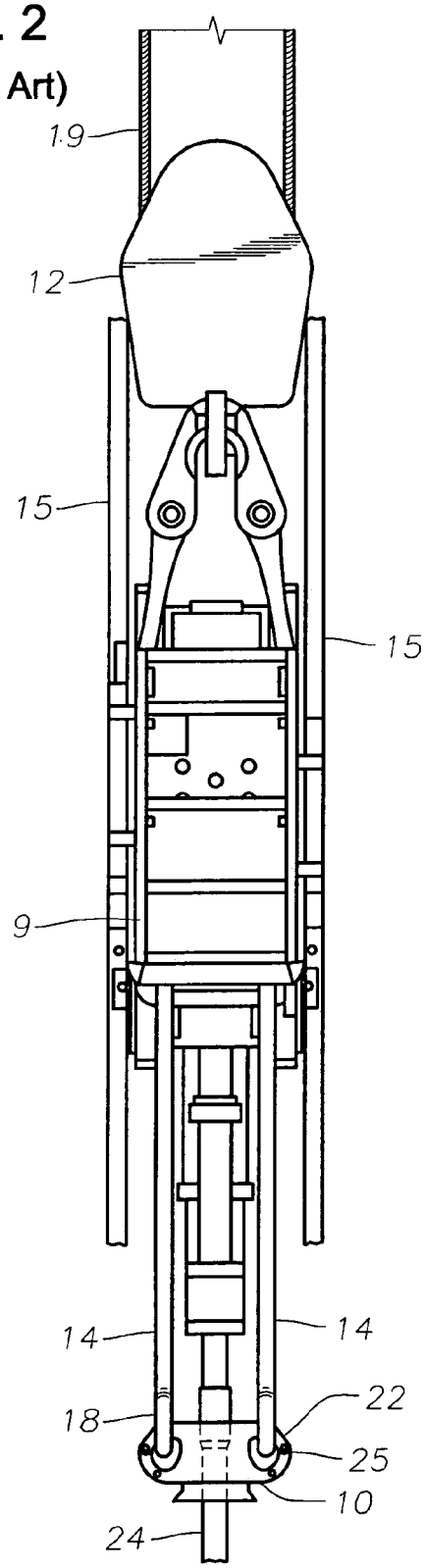
Fig. 2 (Prior Art)
FIG. 2 is a front view of the prior art arrangement of FIG. 1, showing the manually operated locking tabs of the elevator ears.
Figure 3:
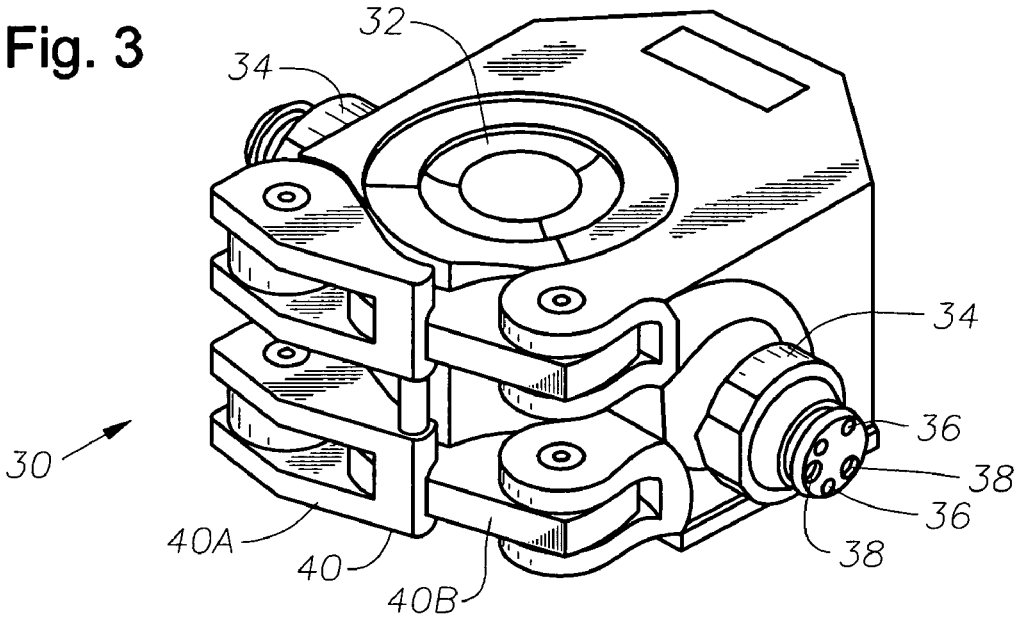
FIG. 3 is a front perspective of an elevator according to one embodiment of the invention showing side-entry doors and an elevator ear equipped with quick connectors designed and arranged to mate with a bail-mounted multi-coupling system connector assembly (not shown)

The preferred embodiment of the invention includes two elevators. FIG. 3 is a front perspective of one of the two elevators 30 according to one embodiment of the invention.

Each elevator 30 preferably has a slip assembly for clamping a tubular 41 (FIG. 4) or bushings 32 which support a tubular stand by the lower lip of a box connector at the upper end of the stand. Each elevator 30 also has a pair of elevator ears 34 for receiving bails or links (not shown) to lift the elevator 30. Although other arrangements may be used, each elevator 30 preferably has quick-connect power and control connections 36 and guide sockets 38 in either one or both elevator ears 34. The elevator ear power and control connections 36 and guide sockets 38 allow automatic coupling and uncoupling of hydraulic, pneumatic, or electric circuits to the elevator 30 when coupled to the bails. The power and control circuits provide power and control to various elevator systems, such as power doors 40 or power slips. Co-pending patent application Ser. No. 11/066,767, filed on Feb. 25, 2005 and entitled "Hands-Free Bail-Elevator Locking Device with Combined Power/Control Connector, Bail Spreader and Method for Use," describes the operation and arrangement of the bail connections 36 and guide sockets 38 and is incorporated herein in its entirety by reference.

Each elevator 30 preferably has a front door assembly 40 which can open to accept side entry of a tubular into the elevator 30. Preferably, a hydraulically operated double door design, as shown in FIG. 3, is used. The double door design, using two doors 40A, 40B each being generally one-half the size of the door in a single door elevator of similar capacity, allows the doors 40A, 40B to be opened and shut in relatively limited spaces. Elevator balance may also be improved in a double door design. Preferably, each elevator 30 is equipped with an interlock to prevent accidental door opening under load.

Figure 4:
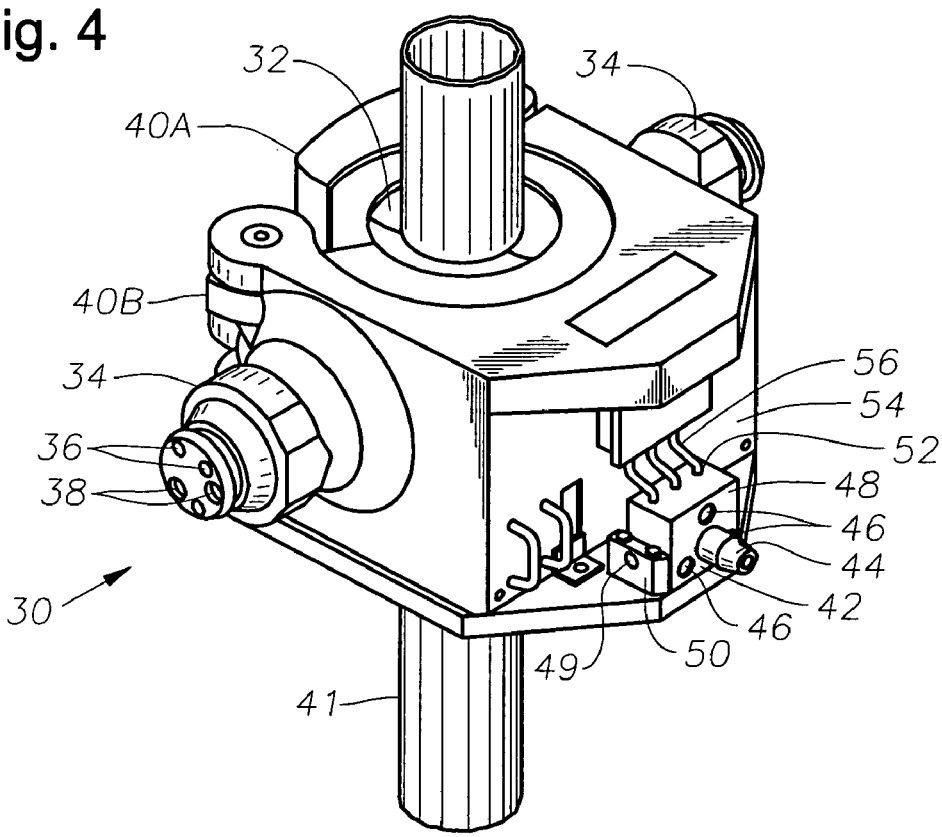
FIG. 4 is a rear perspective of the elevator of FIG. 3, showing the elevator supporting a tubular and showing a rear power and control connector assembly which is designed and arranged to mate with a skid assembly multi-coupling system connector assembly (FIG. 5)

FIG. 4 is a rear perspective of an elevator 30 carrying a tubular 41. Each elevator 30 preferably has a rear power and control connection assembly 42. Like the elevator ear power and control connections 36, the rear power and control connection assembly 42 is used to provide power and control to the elevator doors 40A, 40B and/or other powered elevator systems. The rear power and control connector assembly 42 is intended for use when the elevator 30 is not connected to the bails (not shown), i.e., when the elevator is in a standby position or acting as a spider on the drilling deck, and the elevator ear power and control connectors 36 are intended for use when the elevator 30 is coupled to the bails (not shown).

Referring to FIG. 4, the rear power and control connector assembly 42 preferably consists of a knob hitch 44, which is adapted for remotely actuated coupling to a table shuttle mechanism, and a number of hydraulic, pneumatic, or electric quick-connectors 46 mounted in a block 48. However, the hitch 44 and quick-connectors 46 may be contained in separate assemblies each individually mounted to the elevator. The hydraulic, pneumatic, or electric quick-connectors 46 are analogous in function to the elevator ear 34 power and control connections 36. The rear connector block 48 is preferably pivotally mounted to the elevator 30 using integral gudgeons 49 which act as plain bearings and which are mounted in pillow block housings 50. The rear quick-connect connectors 46 are preferably operatively connected to ports 52 located on a top surface of the block 48 and connected from there to ports on the elevator body 54 using flexible members 56. Although a pivoting rear power and control connector assembly 42 is described, other arrangements may be used. Further, although the location of the rear power and control connector assembly 42 is illustrated generally midway between the elevator ears 34, other suitable locations may be used.

Figure 5:
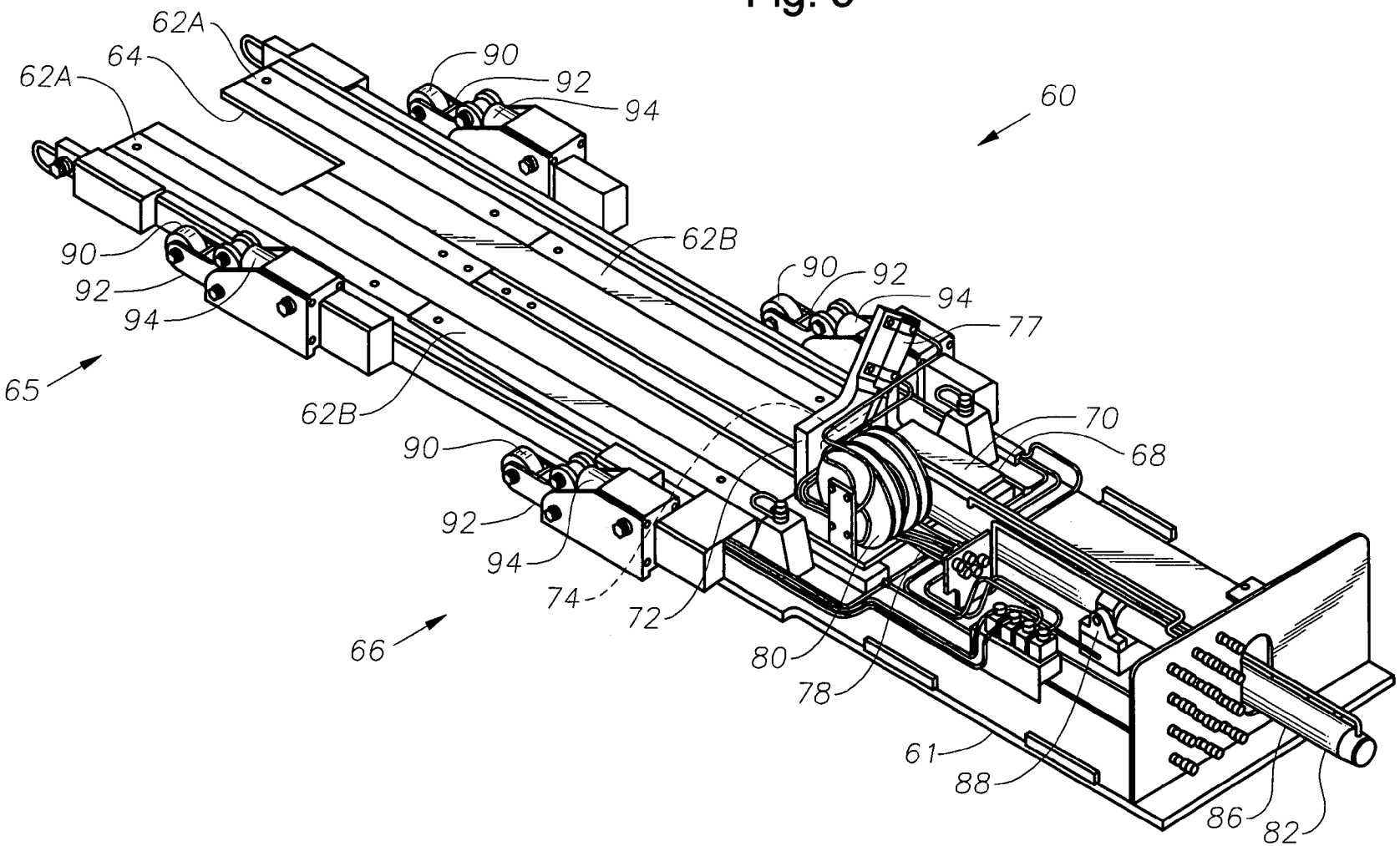
FIG. 5 is a perspective view of a skid assembly according to one embodiment of the invention which is designed and arranged to support two elevators, e.g., of the type shown in FIGS. 3–4 (not shown in FIG. 5), showing a shuttle mechanism adapted to slide an elevator along the skid assembly and showing a multi-coupling system connector assembly mounted on the shuttle mechanism designed to mate with the elevator rear power and control connector assembly of FIG. 4.

As shown in FIG. 5, one or more embodiments also include an elevator table or skid assembly 60. The table or skid assembly includes one or more skids or tracks 62A, 62B, mounted on frame 61, for slideably supporting one or both of the elevators 30 (not shown). The skids 62A, 62B are preferably smooth and well greased to promote sliding of the elevators 30 on the skids. However, other arrangements may be used to promote moving an elevator 30 disposed thereon, e.g., clean Teflon tracks, rollers, wheels, etc. The skid assembly preferably has an aperture 64 for allowing a vertically oriented tubular to pass through. During use, the skid assembly 60 is generally positioned on the drilling deck such that the tubular aperture 64 is disposed at well center. Thus, the position of the skid assembly which contains the aperture 64 is referred to as the well center position 65. The skids 62A near the aperture 64 are preferably level, whereas the skids 62B at a location offset from the aperture 64, referred to as the standby position 66, may have a gentle incline to promote the transfer of the bails (not shown) between an elevator located at well center 65 and the adjacent elevator located in the standby position 66, because the bails, pivoting on the upper eyes (which are generally located near well center), will raise the lower eyes slightly when they are displaced from center to the offset location.

The skids 62A, 62B may also support a shuttle mechanism 68 which is designed and arranged to automatically couple to an elevator rear power and control connector assembly 42 and transfer the coupled elevator 30 between the well center position 65 and standby position 66. The shuttle mechanism 68 preferably includes a sliding horizontal plate 70 and a vertical wall 72. The vertical wall 72 in turn supports the multi-coupling system (MCS) connector assembly 74 which is designed to mate with the elevator rear power and control connector assembly 42.

The MCS connector assembly 74 contains complementary hydraulic, pneumatic, or electric quick-connect connectors 76 (FIGS. 10-11) to the elevator rear connector assembly 42 quick-connectors 46. The elevator power and control circuits (via the MCS connector assembly 74) and a mechanism 77 for locking the elevator 30 to the shuttle mechanism 68 are coupled between the sliding shuttle mechanism 68 and the frame 61 by a number of flexible cables and/or hoses 78. The flexible cables and/or hoses 78 are preferably wound on a number of spring-loaded reels or drums 80, which allow the hoses or cables to be paid out as the shuttle mechanism 68 travels toward the well center position 65 and taken in as the shuttle mechanism 68 returns to the offset standby position 66. However, other suitable means to operatively couple the shuttle mechanism 68 to the fixed skid assembly 60 may also be used.

Figure 6:
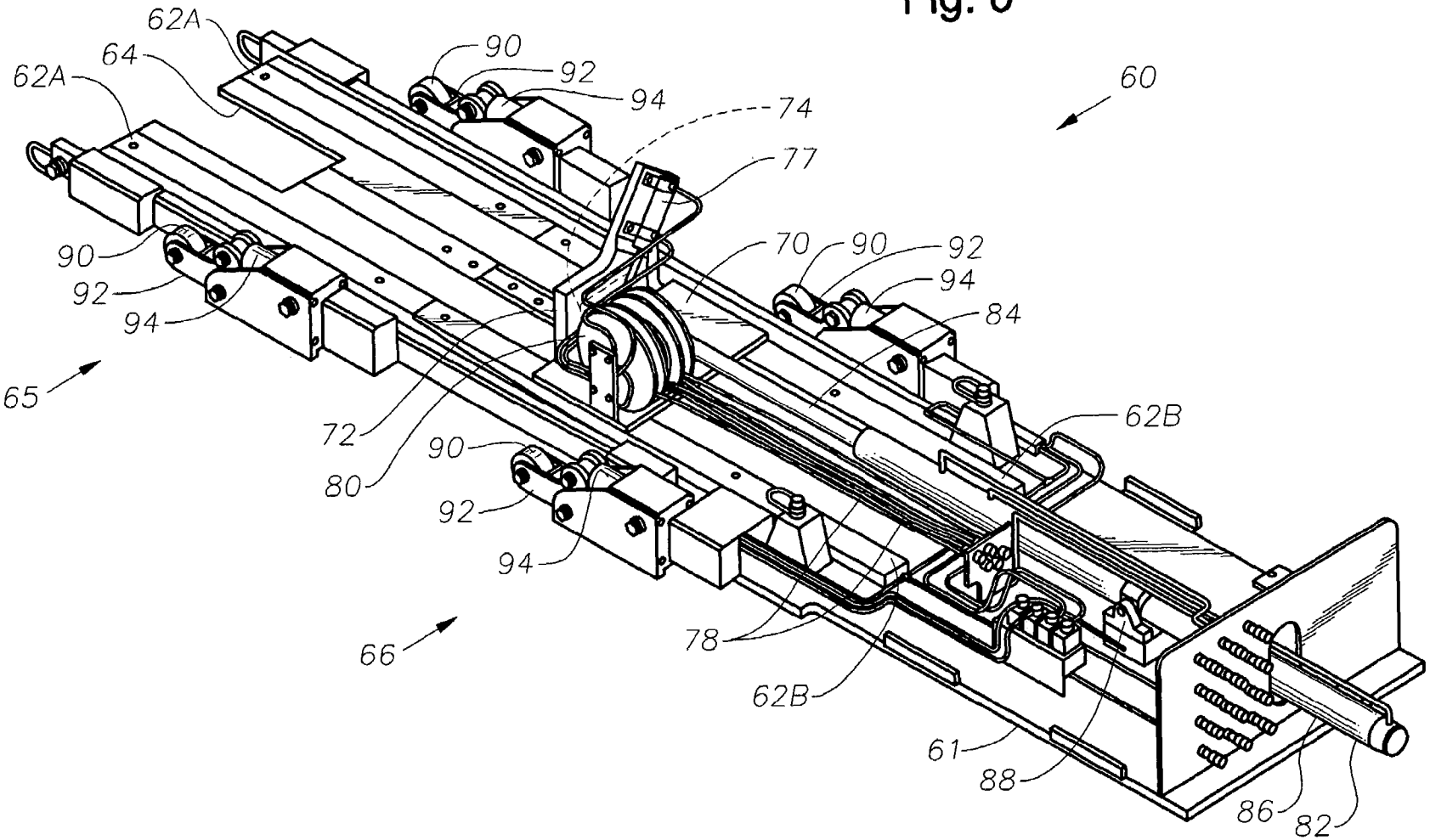
FIG. 6 is a perspective view of the skid assembly of FIG. 5 showing the shuttle mechanism extended toward well center.

As illustrated in FIGS. 5–6, the shuttle mechanism 68 is preferably driven by a hydraulic piston/cylinder arrangement 82, although other means such as a rack and pinion or a lead screw may be used. Like the elevator rear connector block 48, the drive piston 84 is preferably pivotally attached to the shuttle mechanism 68, and the drive cylinder 86 is preferably pivotally mounted to the skid assembly frame 61 using plain bearings in a pillow block housing 88. The pivot mounts for the drive piston/cylinder 82 and for the elevator rear connector assembly 42 allow the shuttle mechanism 68 to move an elevator 30 on both the level skids 62A and the inclined skids 62B. FIG. 5 shows the drive piston fully retracted within the drive cylinder 86 and the shuttle mechanism 68 parked at the standby position 66, and FIG. 6 shows the drive piston 84 extended and the shuttle mechanism 68 near the well center position 65. Thus, when an elevator 30 is coupled to the shuttle mechanism 68, it may be pushed by the shuttle mechanism 68 from the standby position 66 to the well center position 65 or pulled by the shuttle mechanism 68 from the well center position 65 to the standby position 66.

The skid assembly 60 includes wheels or casters 90 to allow the entire skid assembly 60 to be readily and easily moved about the platform deck. Thus, the skid assembly 60 may be quickly moved away from well center when its use is not required. The wheels 90 preferably can be moved to an enabled position, i.e., wheels down, or a disabled position, i.e., wheels up. FIGS. 5–6 show the wheels 90 in the disabled or disengaged position. The disabled wheel position prevents the skid assembly 60 from inadvertently rolling on the deck during use. Due to the weight of the skid assembly (particularly when loaded with two elevators), the wheels are preferably power actuated between the up and down positions. As illustrated, each wheel may be mounted on one end of a bellcrank 92. The opposite end of each bellcrank 92 is actuated by a piston/cylinder arrangement 94. However, other means of engaging and disengaging the wheels 90, e.g., gear drive or lead screws, may be employed.

Figure 7:
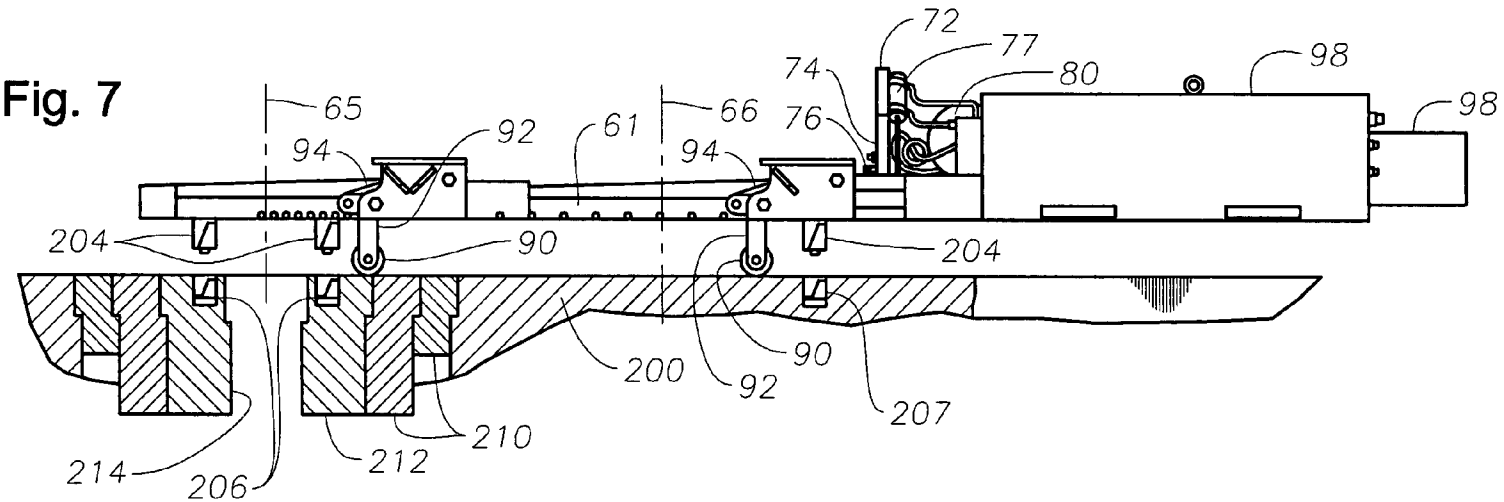
FIG. 7 is a side view of the skid assembly of FIG. 5 with wheels engaged on a drill floor and positioned over a rotary table.
Figure 8:
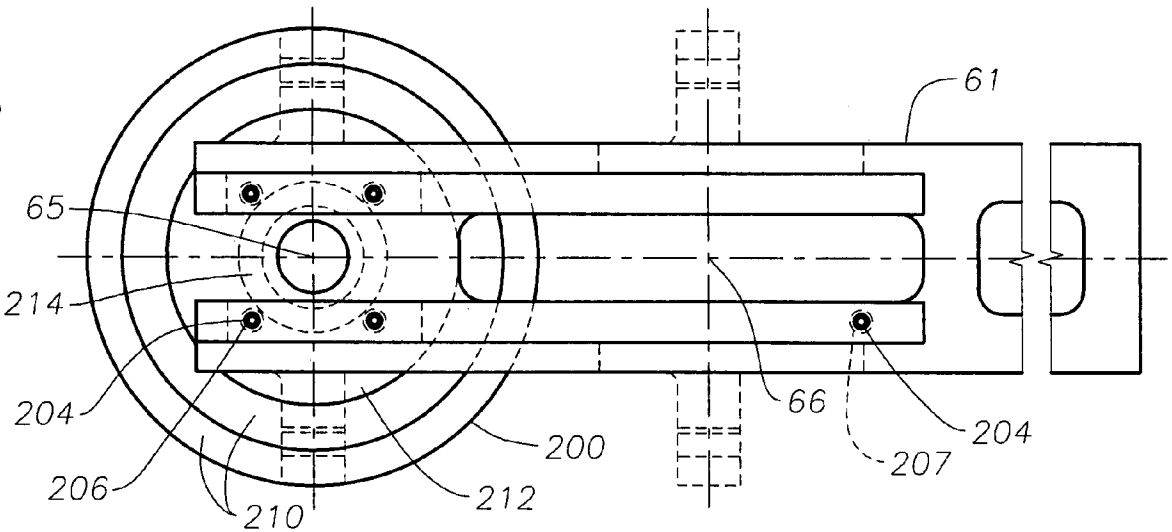
FIG. 8 is a simplified plan view showing the rotary table and skid assembly of FIG. 7.

FIG. 7 shows a side view of the skid assembly 60 with the wheels 90 in the enabled position. The skid assembly 60 is disposed over a rotary table 200 which is preferably recessed in a drill floor. FIG. 8 is a simplified plan view of the skid assembly frame 61 disposed over the rotary table 200. Referring to FIGS. 7 and 8, when the wheels 90 are in the disabled position (wheels up), the skid assembly 60 can be fixed to the rotary table 200 (or any other suitable surface) by using a number of clamping pins 204 disposed below the skid frame 61. Rotary table 200 is shown including one or more adapters 210, a bushing 212 and a bowl 214, but other arrangements may be used.

In a preferred embodiment, the rotary table 200 has four holes 206 intervaled about well center 65 and a fifth hole 207 located near the standby position 66 for receiving and holding the clamping pins 204. However, depending on the rotary table 200 used, other hole configurations may be employed. The skid assembly frame preferably includes an equal number and spacing of clamping pins 204 disposed such that the pins 204 align and mate with the rotary table holes 206, 207. The clamping pins 204 can preferably be screwed from the top and clamp into the holes 206, 207 of the rotary table/drill floor.

Figure 9:
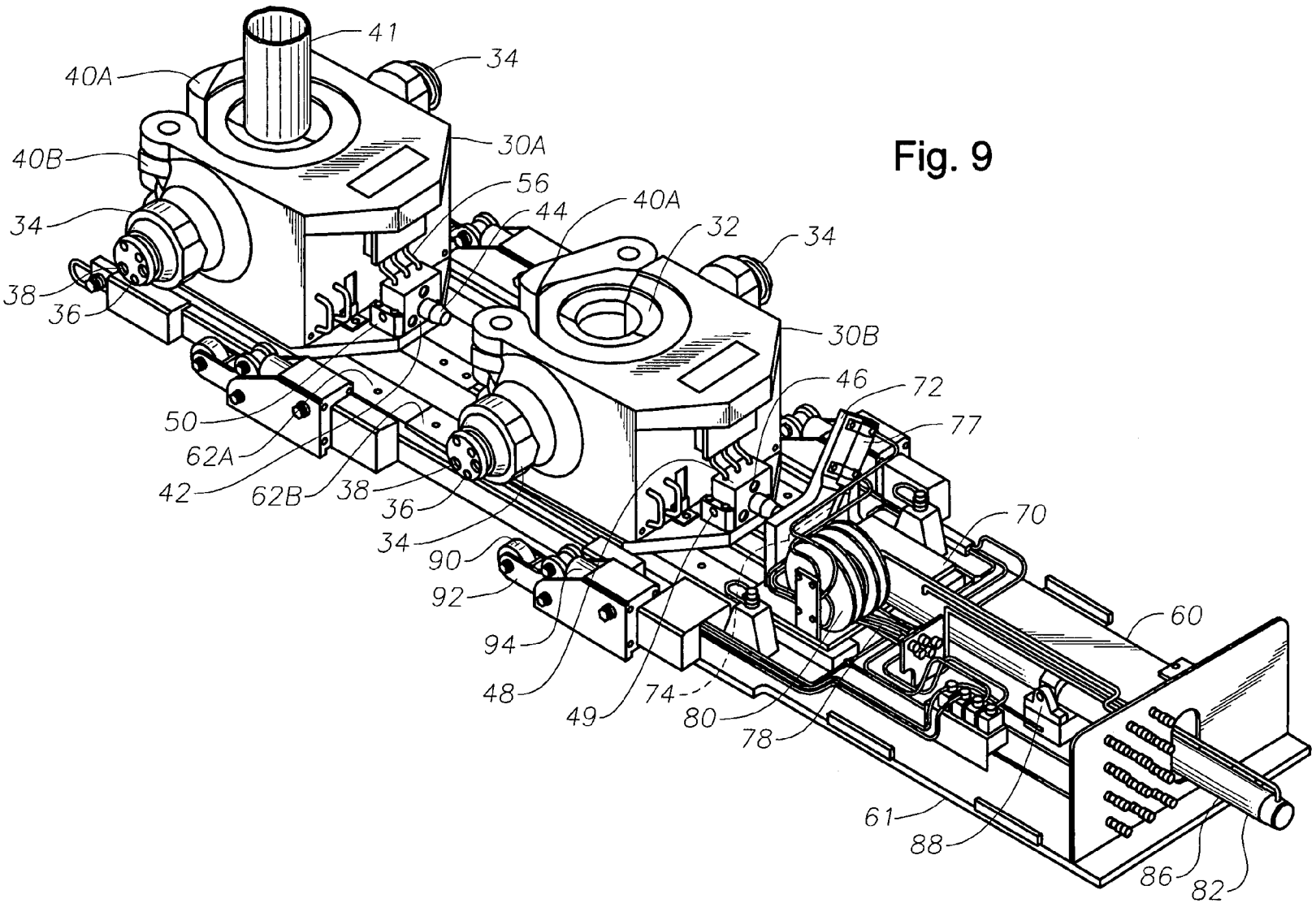
FIG. 9 is a perspective view of the skid assembly of FIG. 5 carrying two elevators of FIGS. 3–4, with the elevator which is positioned at well center supporting a tubular.
Figure 10:
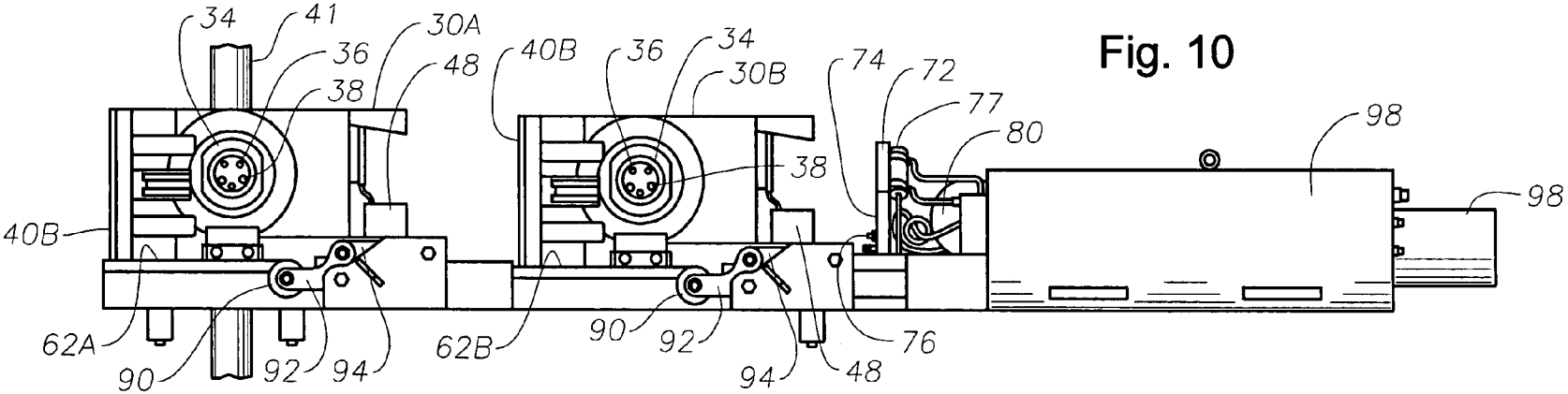
FIG. 10 is a side view of the skid assembly and elevators of FIG. 9 showing a cover over the control apparatus.
Figure 11:
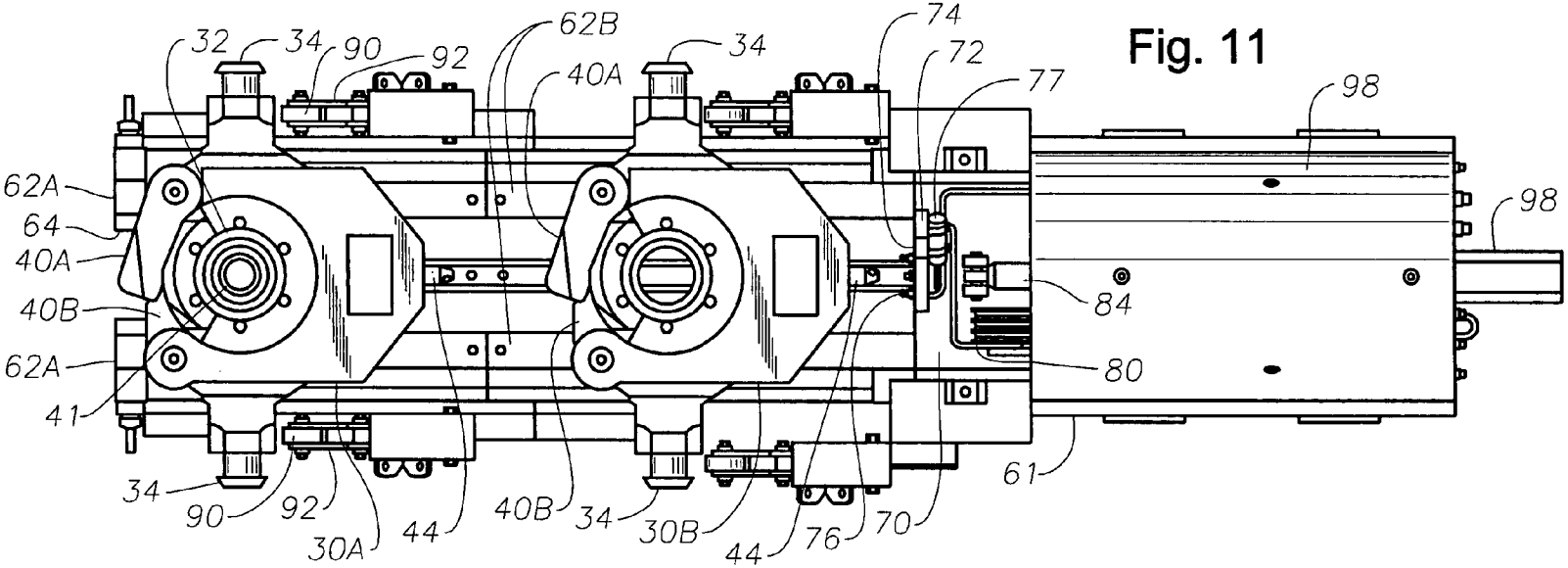
FIG. 11 is a top view of the skid assembly and elevators of FIG. 10.

FIG. 9 shows the skid assembly 60 of FIG. 5 loaded with two elevators 30A, 30B. Elevator 30A is disposed at the well center position 65 and supports a tubular 41 which passes through the tubular aperture 64 (FIG. 5). Elevator 30B is disposed at the offset standby position 66 and is disengaged from but ready for engagement with shuttle mechanism 68. FIGS. 10–11 show the skid assembly 60 and elevators 30A, 30B of FIG. 9, except a cover 98 protects a substantial portion of piston/cylinder 82, drums 80, hoses/cables 78 and associated control apparatus (FIGS. 5–6).

Figure 12:
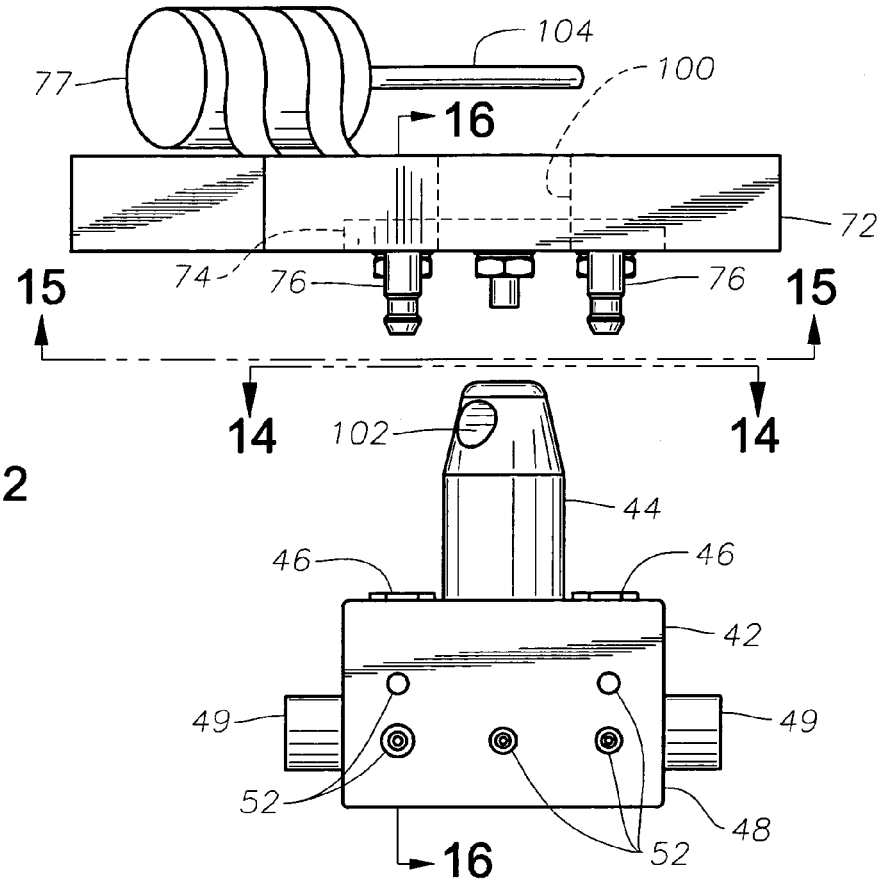
FIG. 12 is a top view explosion diagram showing the mating relationship of the elevator rear power and control connector assembly of FIG. 4 and the skid assembly multi-coupling system connector assembly of FIG. 5.
Figure 13:
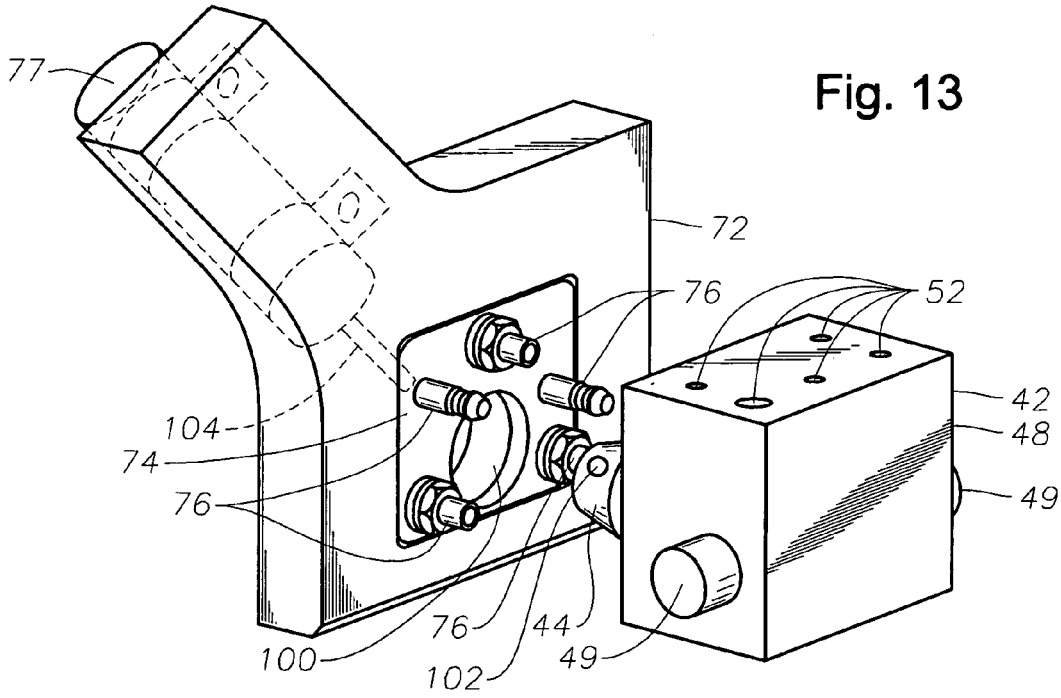
FIG. 13 is a perspective view of the elevator rear power and control connector assembly and the complementary skid assembly multi-coupling system connector assembly of FIG. 12.
Figure 14:
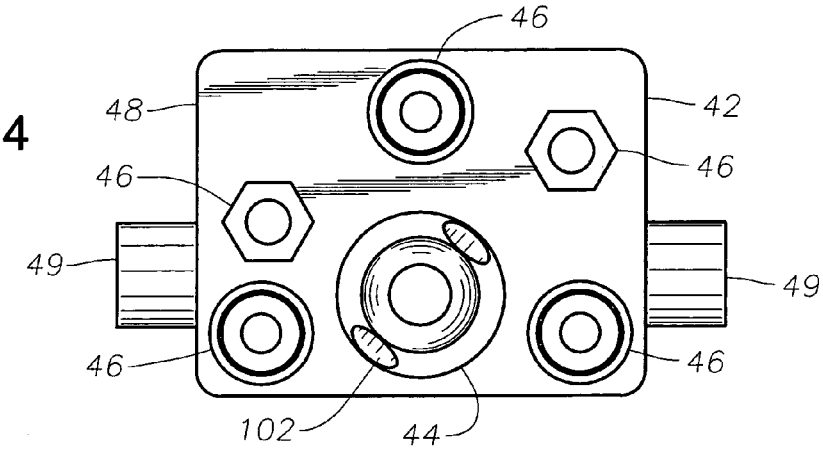
FIG. 14 is a rear view of the elevator rear power and control connector assembly taken along lines 14—14 of FIG. 12.
Figure 16:
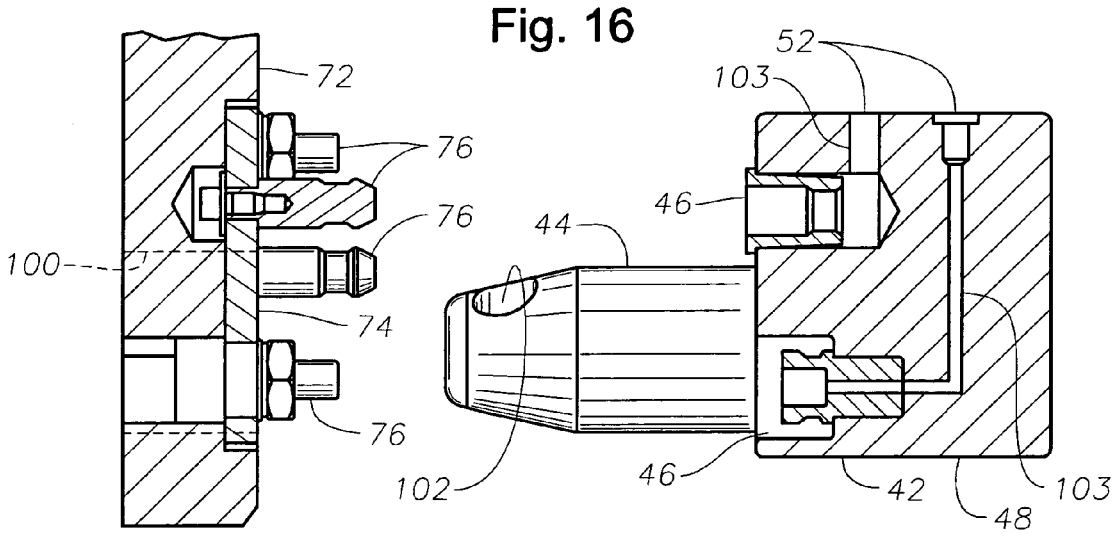
FIG. 16 is a side cross-section of the elevator rear power and control connector assembly and the complementary skid assembly multi-coupling system connector assembly taken along lines 16—16 of FIG. 12.
Figure 18:
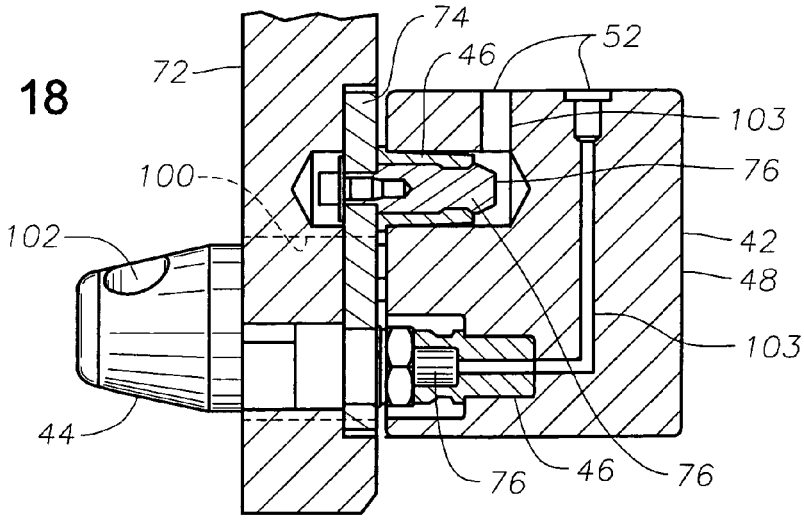
FIG. 18 is a side cross section of the elevator rear power and control connector assembly and the mated skid assembly multi-coupling system connector assembly taken along lines 18—18 of FIG. 16.
Figure 15:
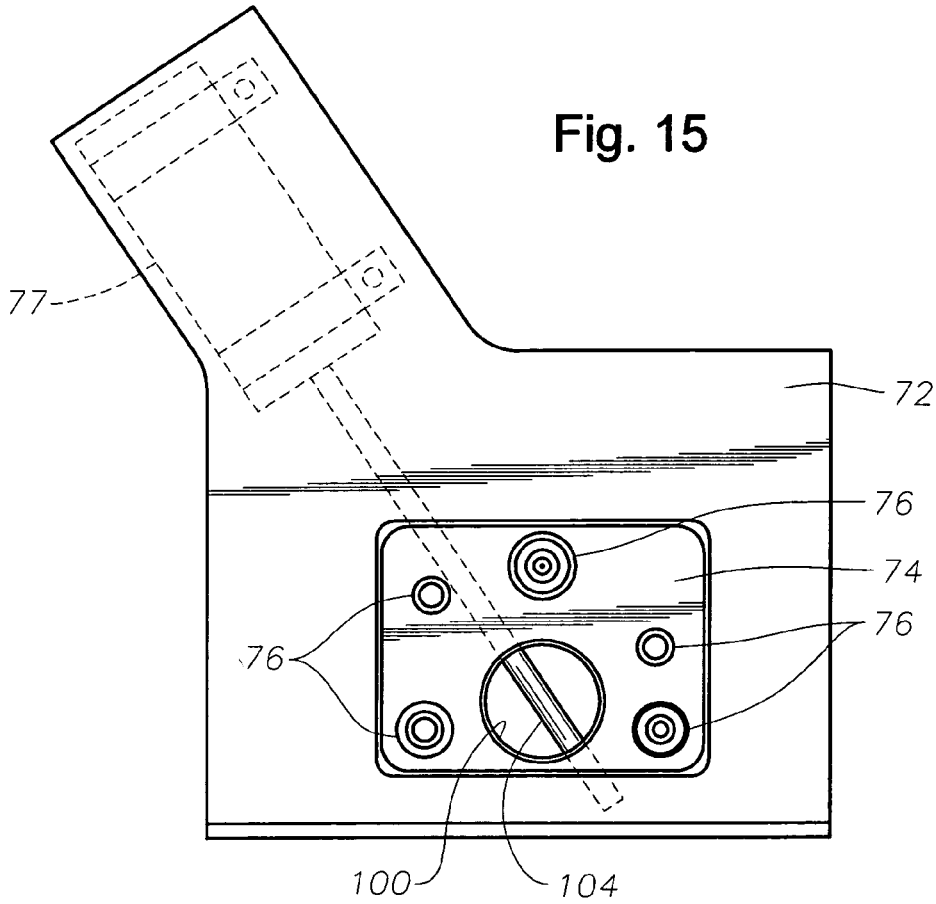
FIG. 15 is a front view of the skid assembly multi-coupling system connector assembly taken along lines 15—15 of FIG. 12.
Figure 17:
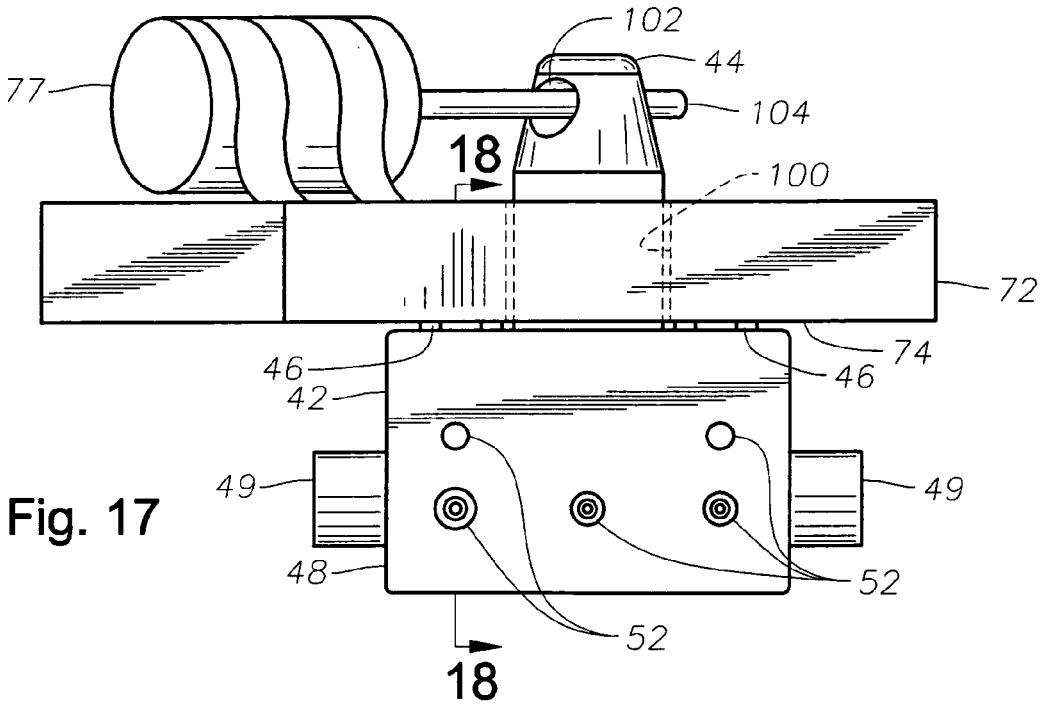
FIG. 17 is a top view of the elevator rear power and control connector assembly and the skid assembly multi-coupling system connector assembly of FIG. 12 showing the two connectors in the mated and locked position.

FIG. 12 is an explosion diagram showing the elevator rear power and control connector assembly 42 and the table MCS connector assembly 74 in uncoupled relation. FIG. 13 is a perspective view of FIG. 12, FIG. 14 is a view of the mating side of the elevator rear power and control connector assembly 42, FIG. 15 illustrates the mating side of the skid assembly MCS connector assembly 74, and FIG. 16 is a cross section of FIG. 12. Likewise, FIGS. 17 and 181 correspond to FIGS. 12 and 16, respectively, but show the two connector assemblies 42, 74 coupled together. Referring collectively to FIGS. 12–18, the knob hitch 44 of the rear connector assembly is designed to be received into a hole 100 in the shuttle mechanism wall 72 and locked in place to form a hitch assembly. The knob hitch 44 has a transverse hole 102 formed therein for receiving a locking pin 104 contained in the shuttle mechanism 68. The locking pin 104 is moved into and out of engagement with the knob hitch 44 by an actuator 77. Preferably, a hydraulic piston/cylinder arrangement is used to actuate the locking pin 104, but other arrangements, e.g., a solenoid, may be used. Alternatively, other suitable hitch arrangements may be used in place of hitch knob 44, actuator 77 and locking pin 104, but the hitch assembly used preferably allows remotely actuated coupling and uncoupling. The skid assembly MCS connector assembly 74 preferably has male quick-connect connectors 76 which are designed and arranged to be received within complementary female quick-connect connectors 46 housed in the elevator rear power and control connector block 48. The MCS quick-connectors 76 are operatively coupled to appropriate power and control systems via flexible cables and/or hoses 78 and rigid conduits mounted to frame 61 (FIG. 5), and the rear power and control quick-connectors 46 are operatively routed through internal passages 103 in block 48 to ports 52 located on top of block 48 and in turn to elevator 30 through flexible members 56 (FIG. 4). The rear power and control connector block 48 preferably has integral gudgeons 49 which pivot within pillow blocks 50 (FIG. 4) to allow the connector assembly pair 74, 42 to function when the shuttle mechanism 68 is positioned on both the level skids 62A and the inclined skids 62B. However, other suitable means to pivot the connectors may be used.

The Abstract of the disclosure is written solely for providing the public at large with a means by which to determine quickly from a cursory inspection the nature and gist of the technical disclosure, and it represents solely a preferred embodiment and is not indicative of the nature of the invention as a whole.

While the preferred embodiments of the invention have been illustrated in detail, it is apparent that modifications and adaptations of the preferred embodiments will occur to those skilled in the art. Such modifications and adaptations are in the spirit and scope of the invention as set forth herein.

What is claimed is:

1. An elevator (30) adapted for holding a tubular (41), said elevator characterized by having first and second elevator ears (34) for attachment to a pair of bails for suspending said elevator, the improvement comprising, a first connector assembly (42) coupled to said elevator at a position other than said first or said second elevator ear and designed and arranged for coupling to a complementary second connector assembly (74) by remote actuation, at least one conduit (103) disposed in said first connector assembly, said conduit operably coupled to said elevator to supply power or control thereto, and a first hitch (44) carried by said elevator at a position other than said first or said second elevator ear, said first hitch designed and arranged for removable attachment to a complementary second hitch (104) by remote actuation and to push or pull said elevator along a surface.

2. The elevator of claim 1 wherein, said first connector assembly (42) is pivotably mounted to said elevator (30) generally midway between said first and said second elevator ears (34).

3. The elevator of claim 1 further comprising, a door assembly (40) designed and arranged to allow side entry of a tubular (41), said door assembly disposed at a side of said elevator generally midway between said first and said second elevator ears (34).

4. A table (60) for supporting first and second elevators (30) and characterized by providing a well center elevator position (65) and a standby elevator position (66) adjacent to said well center elevator position, said table comprising, a frame (61), a first skid surface (62A) coupled to said frame at said well center elevator position and designed and arranged for supporting said first elevator, a second skid surface (62B) coupled to said frame at said standby elevator position and designed and arranged for supporting said second elevator, said second skid surface positioned relative to said first skid surface to allow smooth movement of said first elevator disposed thereon between said standby elevator position and said well center elevator position and vice versa, a shuttle mechanism (68) movably coupled to said frame and having a first hitch (104) mounted thereto which is designed and arranged to attach by remote actuation to a complementary second hitch (44) which is attached to said first elevator, a first connector assembly (74) coupled to said shuttle mechanism and designed and arranged to mate with a complementary second connector assembly (42), coupled to said first elevator, by remote actuation, said first connector assembly designed and arranged to supply power or control to said first elevator, and a shuttle mechanism actuator (82) coupled between said shuttle mechanism and said frame and designed and arranged to move said first elevator hitched to said shuttle mechanism between said well center elevator position and said standby elevator position.

5. The table of claim 4 wherein, said first skid surface (62A) and said second skid surface (62B) are designed and arranged for slideably supporting said first and said second elevators (30), respectively.

6. The table of claim 5 wherein, said shuttle mechanism (68) is slideably disposed on said first skid surface (62A) or said second skid surface (62B).

7. The table of claim 4 further comprising, a plurality of wheels (90) coupled to said frame (61) in movable relation thereto and characterized by engaged positions and disengaged positions such that when said plurality of wheels are disposed in said disengaged positions, said frame rests on a floor surface, and when said plurality of wheels are disposed in said engaged positions, said frame is carried by said plurality of wheels for free movement thereof on said floor surface.

8. The table of claim 7 further comprising, at least one wheel actuator (94) coupled between said frame (61) and at least one of said plurality of wheels (90) designed and arranged to move said at least one of said plurality of wheels between said engaged position and said disengaged position.

9. The table of claim 4 wherein, said second skid surface (62B) is disposed at an incline with respect to said first skid surface (62A).

10. The table of claim 4 further comprising, a flexible conduit (78) operably coupled between said shuttle mechanism and said frame (61) and designed and arranged to supply power or control to said elevator (30) via said first connector assembly (74).

11. The table of claim 4 wherein, said first hitch comprises a locking pin (104) movably coupled to a hitch actuator (77), said locking pin designed and arranged to be received into a hole (102) in said complementary second hitch (44).

12. A dual elevator system for moving a tubular comprising, first and second elevators (30) each adapted for holding a tubular (41) and characterized by having first and second elevator ears (34) for attachment to a pair of bails for suspension therefrom, a first connector assembly (42) designed and arranged for coupling to a complementary second connector assembly (74) by remote actuation and operably coupled to the elevator to supply power or control thereto, and a first hitch (44) designed and arranged to push or pull the elevator along a table surface (62A, 62B) and for removable attachment to a complementary second hitch (104) by remote actuation, and a table (60) for supporting said first and said second elevators and characterized by providing a well center elevator position (65) and a standby elevator position (66) adjacent to said well center elevator position, said table comprising a frame (61), a first skid surface (62A) coupled to said frame at said well center elevator position and designed and arranged for supporting said first elevator, a second skid surface (62B) coupled to said frame at said standby elevator position and designed and arranged for supporting said second elevator, a shuttle mechanism (68) movably coupled to said frame and having said complementary second hitch (104) mounted thereto, said complementary second connector assembly (74) coupled to said shuttle mechanism, and a shuttle mechanism actuator (82) coupled between said shuttle mechanism and said frame and designed and arranged to move said first elevator hitched to said shuttle mechanism between said well center elevator position and said standby elevator position.

13. A method for moving an elevator (30) disposed on a table (60) having a shuttle mechanism (68) comprising the steps of, moving said shuttle mechanism into engagement with said elevator by remote actuation, hitching said shuttle mechanism to said elevator by remote actuation, pushing or pulling said elevator along said table by moving said shuttle mechanism by remote actuation, and providing power or control to said elevator by connecting by remote actuation a first connector assembly (42) disposed on said elevator to a complementary second connector assembly (74) disposed on said shuttle mechanism.

14. A method for moving an elevator (30) disposed on a table (60) having a shuttle mechanism (68) comprising the steps of, moving said mechanism into engagement with said elevator by remote actuation, hitching said shuttle mechanism to said elevator by remote actuation, pushing or pulling said elevator along said table by moving said shuttle mechanism by remote actuation, moving a plurality or wheels (90) mounted to said table into engagement with a floor surface, and rolling said table along said floor surface.

15. The method of claim 14 further comprising the steps of, moving said plurality of wheels into disengagement from said floor surface, and fastening said table to said floor surface by inserting a plurality of pins which extend downward from said table into a plurality of holes disposed in said floor surface.

* * * * *